US008192187B2

(12) United States Patent
Ohtsuka et al.

(10) Patent No.: US 8,192,187 B2
(45) **Date of Patent: *Jun. 5, 2012**

(54) COMPRESSOR WITH SCREW ROTOR AND GATE ROTOR

(75) Inventors: Kaname Ohtsuka, Sakai (JP); Takanori Murono, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 370 days.

This patent is subject to a terminal disclaimer.

(21) Appl. No.: 12/447,839

(22) PCT Filed: Oct. 23, 2007

(86) PCT No.: PCT/JP2007/070643

§ 371 (c)(1),
(2), (4) Date: Apr. 29, 2009

(87) PCT Pub. No.: WO2008/053749

PCT Pub. Date: May 8, 2008

(65) Prior Publication Data

US 2010/0003153 A1 Jan. 7, 2010

(30) Foreign Application Priority Data

Nov. 2, 2006 (JP) ..... 2006-299227

(51) Int. Cl.
*F03C 4/00* (2006.01)
*F04C 2/00* (2006.01)
*F04C 18/00* (2006.01)

(52) U.S. Cl. ..... 418/195; 418/104; 418/116

(58) Field of Classification Search ..... 418/104, 418/111, 150, 195, 210
See application file for complete search history.

(56) References Cited

U.S. PATENT DOCUMENTS

| | | | | |
|---|---|---|---|---|
| 3,180,565 | A * | 4/1965 | Zimmern | 418/195 |
| 3,904,331 | A * | 9/1975 | Rylewski | 418/111 |
| 3,905,731 | A * | 9/1975 | Zimmern | 418/195 |
| 4,179,250 | A * | 12/1979 | Patel | 418/195 |
| 7,153,112 | B2 * | 12/2006 | Zarnoch et al. | 418/195 |

FOREIGN PATENT DOCUMENTS

| | | | | |
|---|---|---|---|---|
| JP | 54-034086 | B | 10/1979 | |
| JP | 60-010161 | B | 3/1985 | |
| JP | 06101668 | A * | 4/1994 | 418/195 |

* cited by examiner

*Primary Examiner* — Theresa Trieu
(74) *Attorney, Agent, or Firm* — Global IP Counselors

(57) ABSTRACT

A compressor includes a screw rotor and a gate rotor. The screw rotor has a plurality of spirally extending groove portions disposed radially outwardly from the center axis of the screw rotor. The gate rotor has a plurality of tooth portions circumferentially arranged on an outer circumference to engage the groove portions. Preferably, an inclination angle of a groove portion side face contacting the tooth portions is inclined relative to a circumferential direction of the gate rotor varies. Alternatively a first plane contains the screw rotor center axis, a second plane orthogonally intersects the screw rotor center axis, a third plane orthogonally intersects the first and second planes, the gate rotor center axis is on the third plane, and the tooth portions do not overlap the first plane as viewed orthogonally relative to the third plane.

5 Claims, 14 Drawing Sheets

COMPRESSOR WITH SCREW ROTOR AND GATE ROTOR

CROSS-REFERENCE TO RELATED APPLICATIONS

This U.S. National stage application claims priority under 35 U.S.C. §119(a) to Japanese Patent Application No. 2006-299227, filed in Japan on Nov. 2, 2006, the entire contents of which are hereby incorporated herein by reference.

TECHNICAL FIELD

The present invention relates to a compressor to be used in, for example, air conditioners, refrigerators and the like.

BACKGROUND ART

Conventionally, there has been provided a compressor including a disc-shaped screw rotor which rotates about a center axis and which has, in its end face in a center-axis direction, a plurality of spirally extending groove portions radially outward from the center axis, and a gate rotor which rotates about a center axis and which has a plurality of tooth portions arrayed circumferentially on its outer circumference, the groove portions of the screw rotor and the tooth portions of the gate rotor being engaged with each other to form a compression chamber (see JP 60-10161 B).

That is, this compressor is a so-called PP type single screw compressor. The term "PP type" means that the screw rotor is formed into a plate-like shape and moreover the gate rotor is formed into a plate-like shape.

Then, as viewed in a direction orthogonal to the screw rotor center axis and the gate rotor center axis, all the tooth portions of the gate rotor overlap with the screw rotor center axis. That is, the tooth portions of the gate rotor are engaged with the groove portions of the screw rotor along the radial direction of the screw rotor.

With a view to preventing interferences between the screw rotor and the gate rotor, side faces of the gate rotor tooth portions are given a maximum angle and a minimum angle each of which is formed by a gate rotor tooth-portion side face and a screw rotor groove wall surface on a plane which orthogonally intersects with the gate rotor plane and which contains a rotational direction of a tooth center line extending radial direction of the gate rotor (hereinafter, angles formed between the maximum angle and the minimum angle will be referred to as edge angles of the gate rotor; see edge angles δ1, δ2 of FIG. 20).

SUMMARY OF INVENTION

Technical Problem

However, with the conventional compressor described above, since all the tooth portions of the gate rotor are aligned with the screw rotor center axis as viewed in a direction orthogonal to the screw rotor center axis and the gate rotor center axis, angles formed by side faces of the screw rotor groove against side faces of the gate rotor tooth portions on the plane orthogonally intersecting with the gate rotor plane and containing the rotational direction of the gate rotor tooth center line involves a larger difference between a maximum value and a minimum value.

As a result of this, edge angles of gate rotor seal portions to be engaged with the side faces of the screw rotor groove portion become acute, so that a blow hole (leak clearance) present at an engagement portion between the screw rotor groove portion and the gate rotor tooth portion becomes larger. This would result in a lowered compression efficiency.

Accordingly, an object of the present invention is to provide a compressor in which the blow hole is made smaller so as to improve the compression efficiency.

Solution to Problem

In order to achieve the above object, there is provided a compressor comprising: a disc-shaped screw rotor which rotates about a center axis and which has, in at least one end face thereof in a direction along the center axis, a plurality of spirally extending groove portions radially outward from the center axis; and a gate rotor which rotates about a center axis and which has a plurality of tooth portions arrayed circumferentially on its outer circumference, the groove portions of the screw rotor and the tooth portions of the gate rotor being engaged with each other to form a compression chamber, wherein a variation width of an inclination angle to which a side face of a groove portion of the screw rotor to be in contact with the tooth portions of the gate rotor is inclined against a circumferential direction of the gate rotor, the variation being over a range from radially outer side to inner side of the screw rotor, is made smaller than a variation width resulting when all the tooth portions of the gate rotor overlap with a plane containing the screw rotor center axis.

With such a compressor, the variation width of the inclination angle to which the side face of the groove portion of the screw rotor to be in contact with the tooth portions of the gate rotor is inclined against the circumferential direction of the gate rotor, the variation being over a range from radially outer side to inner side of the screw rotor, is made smaller than a variation width resulting when all the tooth portions of the gate rotor overlap with a plane containing the screw rotor center axis. Therefore, edge angles of the seal portions of the gate rotor to be engaged with side faces of the groove portion of the screw rotor can be made obtuse, so that the blow holes (leak clearances) present at engagement portions between the groove portion of the screw rotor and the tooth portions of the gate rotor can be made smaller, allowing the compression efficiency to be improved. Besides, wear of the seal portions of the gate rotor can be reduced, allowing an improvement in durability to be achieved.

Also, there is provided a compressor comprising: a disc-shaped screw rotor which rotates about a center axis and which has, in at least one end face thereof in a direction along the center axis, a plurality of spirally extending groove portions (10) radially outward from the center axis; and a gate rotor which rotates about a center axis and which has a plurality of tooth portions arrayed circumferentially on its outer circumference, the groove portions of the screw rotor and the tooth portions of the gate rotor being engaged with each other to form a compression chamber, wherein with respect to a first plane containing the screw rotor center axis, a second plane which intersects orthogonally with the screw rotor center axis, and a third plane which intersects orthogonally with the first plane (S1) and the second plane, the gate rotor center axis is on the third plane, and at least one of all the tooth portions of the gate rotor does not overlap with the first plane as viewed in a direction orthogonal to the third plane.

With such a compressor, the gate rotor center axis is on the third plane, and at least one of all the tooth portions of the gate rotor does not overlap with the first plane as viewed in a direction orthogonal to the third plane. Therefore, the side face of the groove portion of the screw rotor to be in contact with the tooth portions of the gate rotor can be set at approximately 90° against the rotational direction of the gate rotor (i.e. circumferential direction of the gate rotor) in its portion to be in contact with the side face of the groove portion of the screw rotor. Thus, the variation width of an angle formed by the side face of the groove portion of the screw rotor (hereinafter, referred to as screw rotor groove inclination angle) against a plane orthogonally intersecting with the rotational direction of the gate rotor (the circumferential direction of the gate rotor) can be made smaller.

Therefore, edge angles of the seal portions of the gate rotor to be engaged with side faces of the groove portion of the screw rotor can be made obtuse, so that the blow holes (leak clearances) present at engagement portions between the groove portion of the screw rotor and the tooth portions of the gate rotor can be made smaller, allowing the compression efficiency to be improved. Besides, wear of the seal portions of the gate rotor can be reduced, allowing an improvement in durability to be achieved.

In accordance with one aspect of the present invention, as viewed in the direction orthogonal to the third plane, a distance from an intersection point between a gate rotor plane formed by the first plane side end face of every tooth portion of the gate rotor and the gate rotor center axis (2*a*) to the first plane is 0.05 to 0.4 time as large as an outer diameter of the tooth portion of the gate rotor.

With such a compressor in accordance with this aspect of the present invention, as viewed in the direction orthogonal to the third plane, a distance from an intersection point between a gate rotor plane formed by the first plane side end face of every tooth portion of the gate rotor and the gate rotor center axis to the first plane is 0.05 to 0.4 time as large as an outer diameter of the tooth portion of the gate rotor. Therefore, the variation width of the screw rotor groove inclination angle can be made even smaller.

In accordance with one aspect of the present invention, as viewed in the direction orthogonal to the third plane, the gate rotor center axis is inclined by 5° to 30° against the second plane so that a tooth portion of the gate rotor closer to the screw rotor becomes closer to the screw rotor center axis than a tooth portion of the gate rotor farther from the screw rotor.

With such a compressor, as viewed in the direction orthogonal to the third plane, the gate rotor center axis is inclined by 5° to 30° against the second plane so that a tooth portion of the gate rotor closer to the screw rotor becomes closer to the screw rotor center axis than a tooth portion of the gate rotor farther from the screw rotor. Therefore, the variation width of the screw rotor groove inclination angle can be made even smaller.

In accordance with one aspect of the present invention, as viewed in a direction orthogonal to the first plane, a distance between the gate rotor center axis and the screw rotor center axis is 0.7 to 1.2 times as large as an outer diameter of the gate rotor.

With such a compressor, as viewed in a direction orthogonal to the first plane, a distance L between the gate rotor center axis and the screw rotor center axis is 0.7 to 1.2 times as large as an outer diameter D of the gate rotor. Therefore, the distance L can be made smaller, allowing a downsizing to be achieved.

In accordance with one aspect of the present invention, seal portions of the tooth portions of the gate rotor to be in contact with the groove portions of the screw rotor are formed into a curved-surface shape.

With such a compressor, since the seal portions of the tooth portions of the gate rotor to be in contact with the groove portion of the screw rotor are formed into a curved-surface shape, leakage of the compressed fluid from engagement portions between the tooth portions of the gate rotor and the groove portion of the screw rotor can be reduced, so that the compression efficiency can be improved.

Advantageous Effects of Invention

With a compressor in accordance with an embodiment of the present invention, the variation width of the inclination angle to which the side face of the groove portion of the screw rotor to be in contact with the tooth portions of the gate rotor is inclined against the circumferential direction of the gate rotor, the variation being over a range from radially outer side to inner side of the screw rotor, is made smaller than a variation width resulting when all the tooth portions of the gate rotor overlap with a plane containing the screw rotor center axis. Therefore, the blow holes can be made smaller, allowing the compression efficiency to be improved.

Also, with a compressor in accordance with an embodiment of the present invention, the gate rotor center axis is on the third plane, and at least one of all the tooth portions of the gate rotor does not overlap with the first plane as viewed in a direction orthogonal to the third plane. Therefore, the blow holes can be made smaller, allowing the compression efficiency to be improved.

DESCRIPTION OF EMBODIMENTS

Hereinbelow, the present invention will be described in detail by way of embodiment thereof illustrated in the accompanying drawings.

Figure 1:
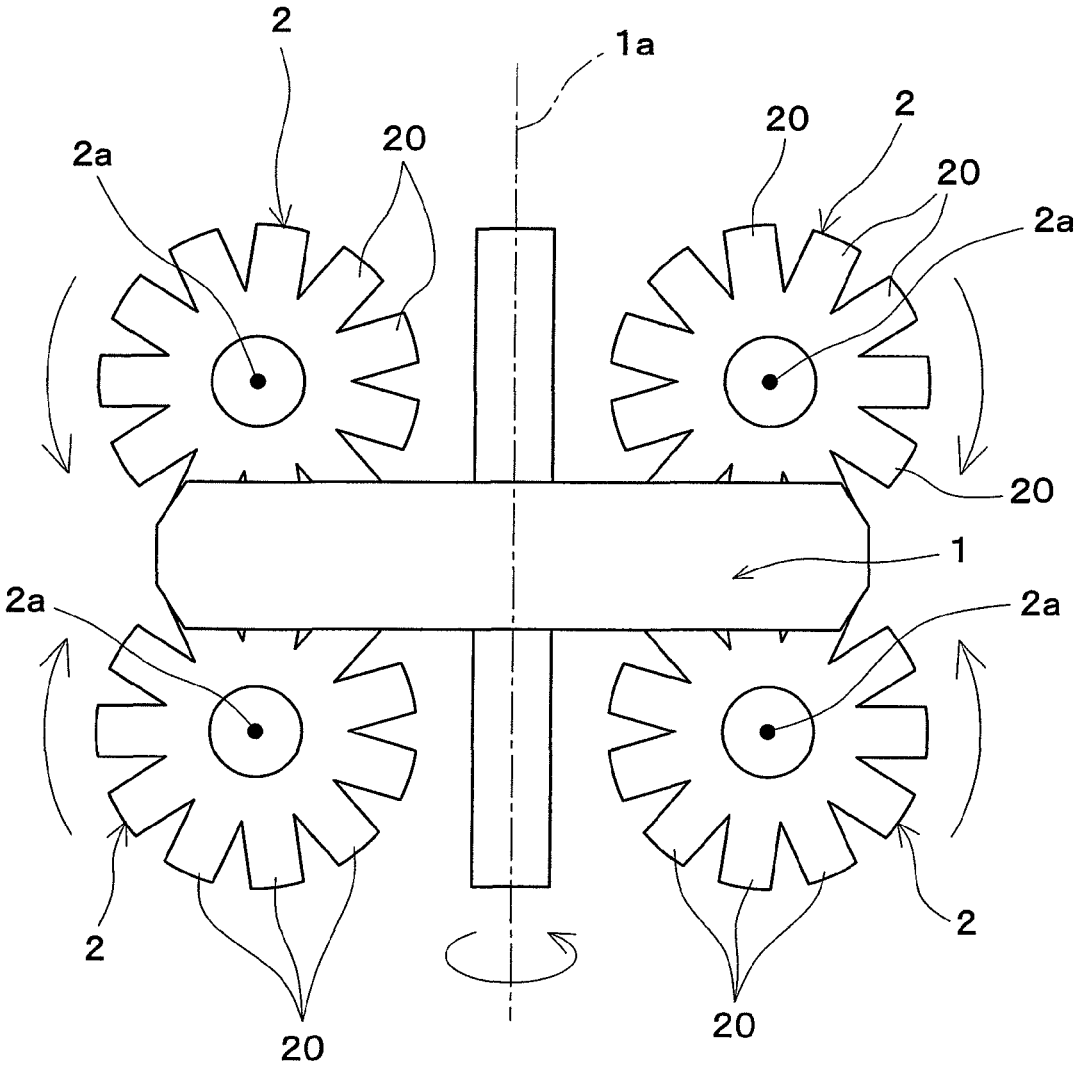
FIG. 1 is a simplified structural view showing an embodiment of the compressor of the invention.
Figure 2:
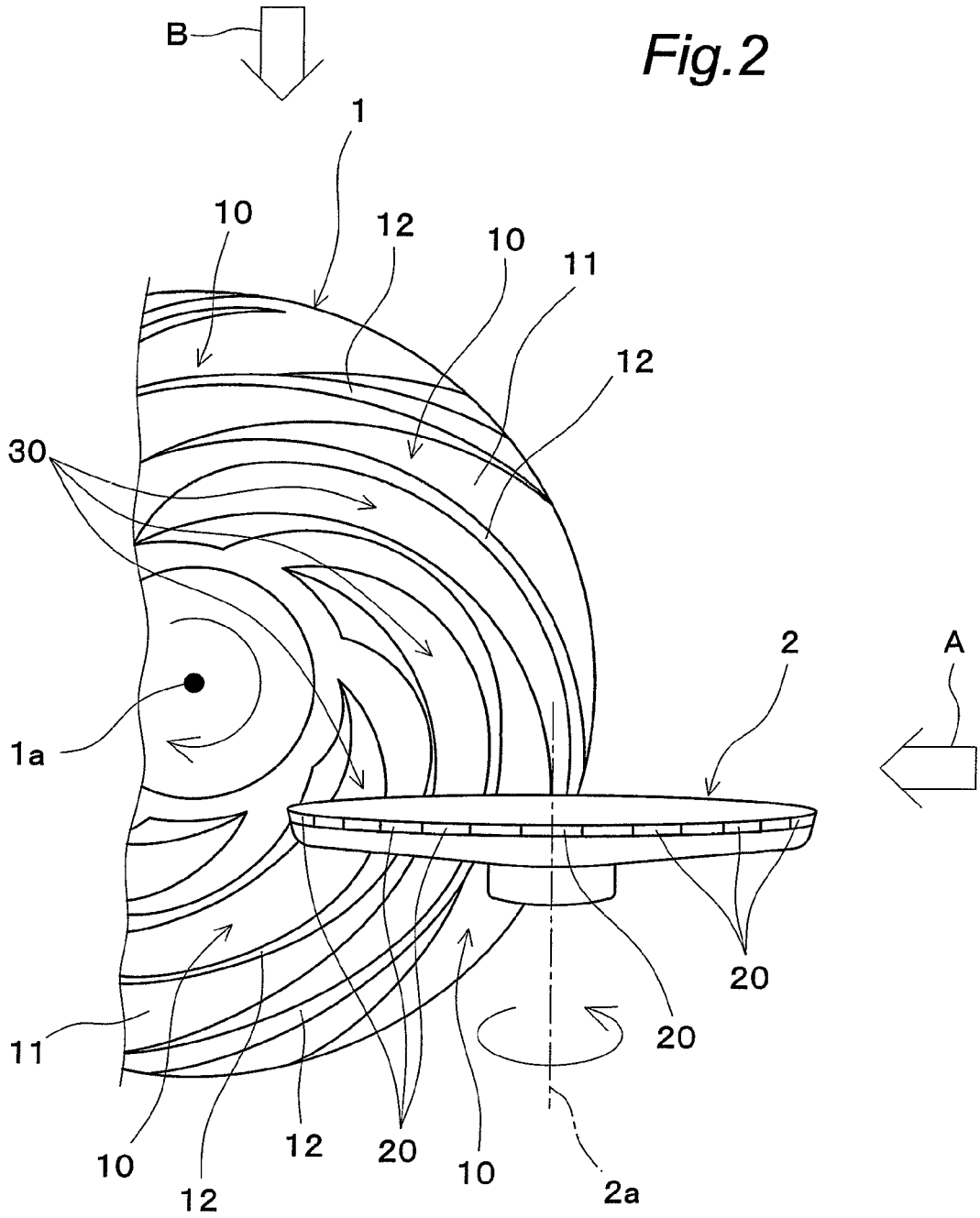
FIG. 2 is a partial enlarged view of the compressor.

FIG. 1 shows a simplified structural view which is an embodiment of the compressor of the invention. FIG. 2 shows a partial enlarged view of the compressor. As shown in FIGS. 1 and 2, the compressor includes: a disc-shaped screw rotor 1 which rotates about a center axis 1*a* and which has, in its end face in a direction along the center axis 1*a*, a plurality of spirally extending groove portions 10 radially outward from the center axis 1*a*; and a disc-shaped gate rotor 2 which rotates about a center axis 2*a* and which has a plurality of tooth portions 20 arrayed circumferentially on its outer circumference, the groove portions 10 of the screw rotor 1 and the tooth portions 20 of the gate rotor 2 being engaged with each other to form a compression chamber 30.

That is, this compressor is a so-called PP-type single screw compressor. The term 'PP-type' means that the screw rotor 1 is formed into a plate-like shape while the gate rotor 2 is formed into a plate-like shape. This compressor is to be used in, for example, air conditioners, refrigerators and the like.

The groove portions 10 are formed in each of two end faces of the screw rotor 1. The gate rotor 2 is provided two in number on each end face of the screw rotor 1. Then, as the screw rotor 1 rotates about the screw rotor center axis 1*a* along a direction indicated by an arrow, each gate rotor 2 subordinately rotates about the gate rotor center axis 2*a* along an arrow direction by mutual engagement of the groove portions 10 and the tooth portions 20.

On an end face of the screw rotor 1 are provided a plurality of thread ridges 12 spirally extending radially outward from the screw rotor center axis 1*a*, where the groove portions 10 are formed between neighboring ones of the thread ridges 12, 12. With one of the tooth portions 20 engaged with one of the groove portions 10, side faces (i.e. seal portions) of the tooth portion 20 come into contact with side faces 11 of the groove portion 10 to seal the compression chamber 30, while the tooth portion 20 is rotated by the side faces 11 of the groove portion 10.

On an end face of the screw rotor 1 is attached a casing (not shown) which has grooves that allow the gate rotors 2 to rotate. A space closed by the groove portion 10, the tooth portion 20 and the casing serves as the compression chamber 30.

In the casing is provided a suction port (not shown) communicating with the groove portions 10 on the outer peripheral side of the screw rotor 1. In the casing is also provided a discharge port (not shown) communicating with the groove portions 10 on the center side of the screw rotor 1.

Referring to action of the compressor, a fluid such as refrigerant gas introduced to the groove portion 10 through the suction port is compressed in the compression chamber 30 as the capacity of the compression chamber 30 is reduced by rotation of the screw rotor 1 and the gate rotor 2. Then, the compressed fluid is discharged through the discharge port.

Figure 3:
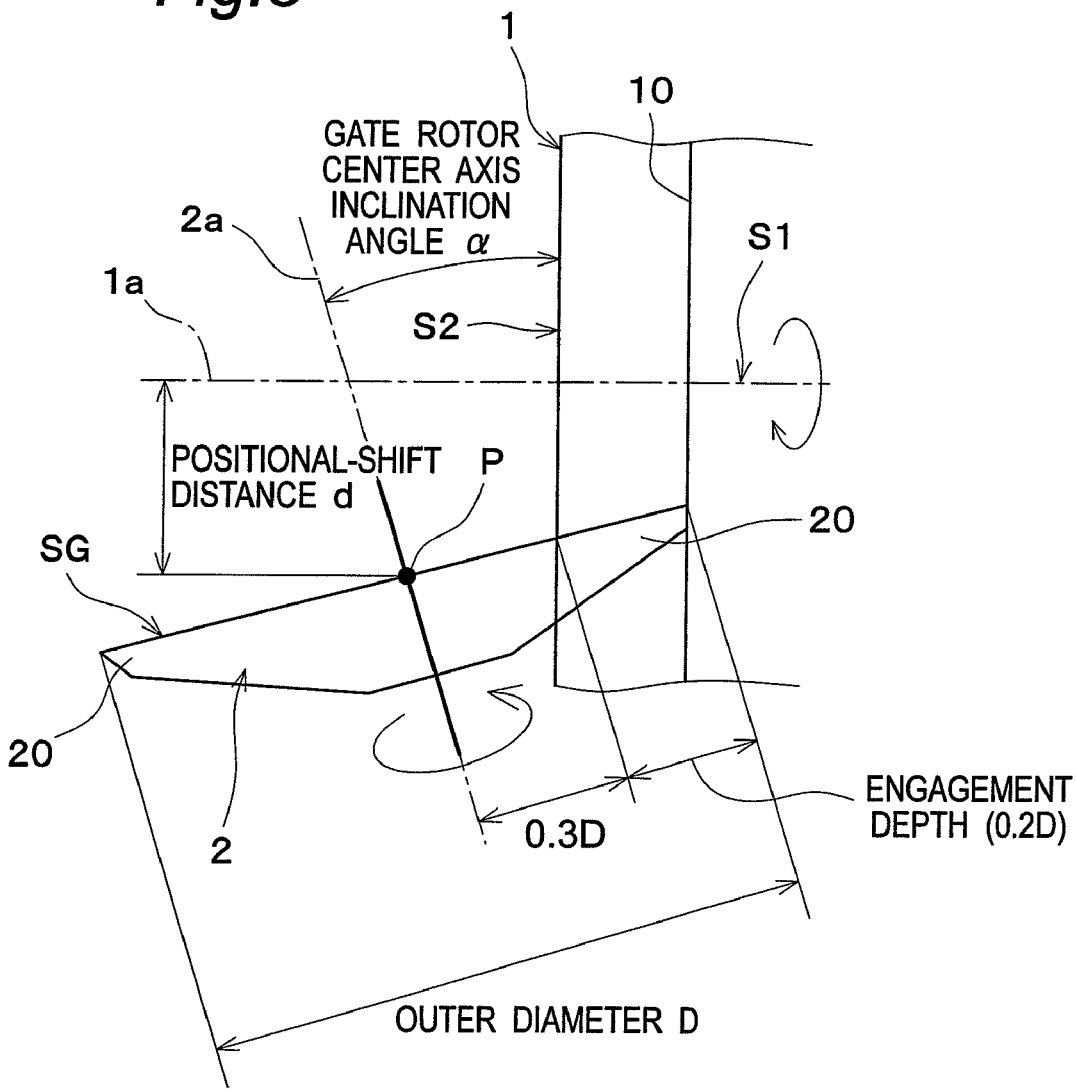
FIG. 3 is a simplified side view of the compressor.
Figure 4:
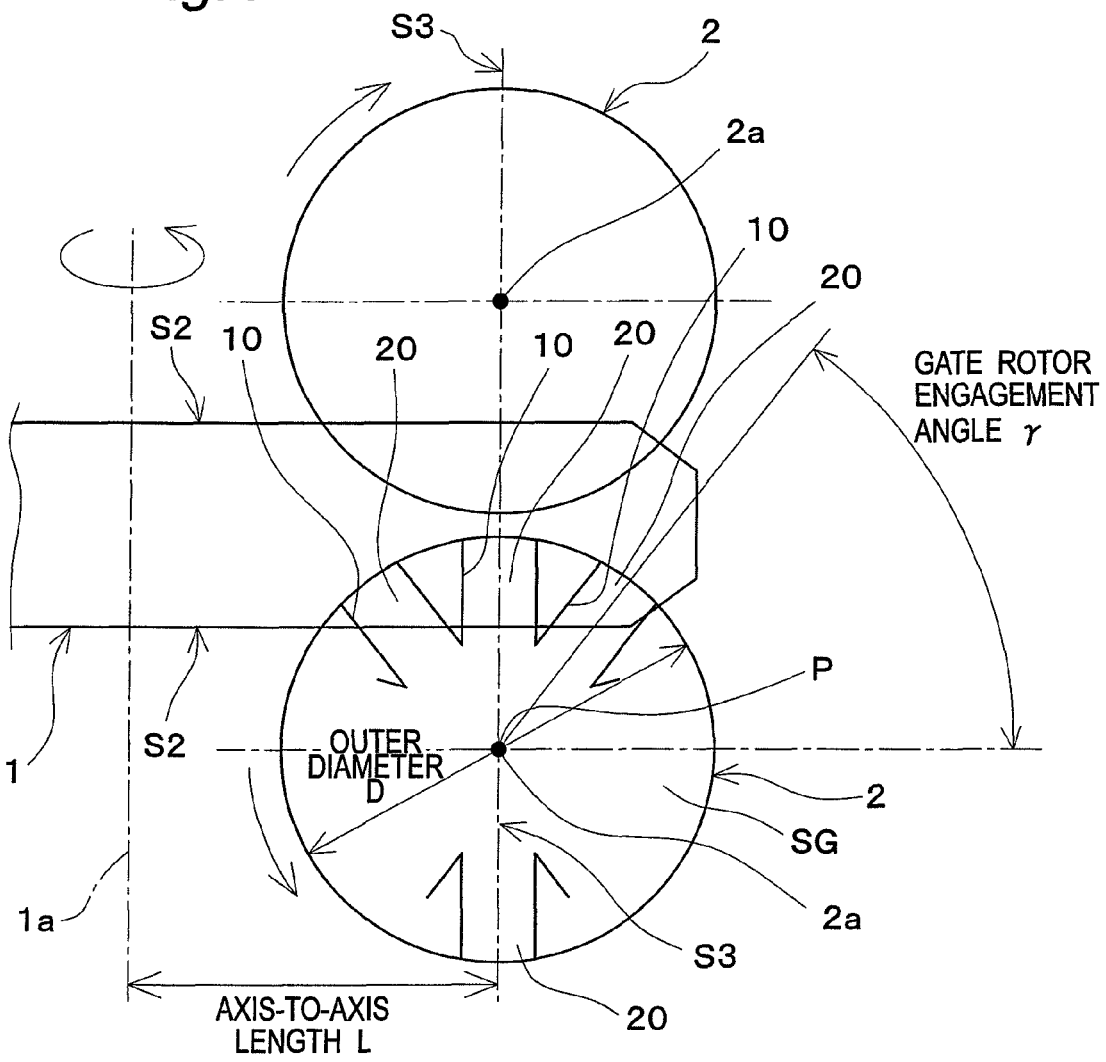
FIG. 4 is a simplified plan view of the compressor.

As shown in the simplified front view of FIG. 3 and the simplified plan view of FIG. 4, there are defined a first plane S1 containing the screw rotor center axis 1*a*, a second plane S2 orthogonally intersecting with the screw rotor center axis 1*a*, and a third plane S3 orthogonally intersecting with the two planes of the first plane S1 and the second plane S2. The second plane S2 is coincident with the axial end face of the screw rotor 1. FIG. 3 is a view taken along an arrow A direction of FIG. 2, and FIG. 4 is a view taken along an arrow B direction of FIG. 2.

The gate rotor center axis 2*a* is on the third plane S3. None of the tooth portions 20 of the gate rotor 2 overlaps with the first plane S1 as viewed in a direction orthogonal to the third plane S3.

As viewed in the direction orthogonal to the third plane S3, a distance d from an intersection point between a gate rotor plane SG formed by an first plane S1 side end face of every tooth portion 20 of the gate rotor 2 and the gate rotor center axis 2*a* to the first plane S1 (hereinafter, referred to as positional-shift distance d) is 0.05 to 0.4 time as large as an outer diameter D of the tooth portion 20 of the gate rotor 2 ($0.05D \leqq d \leqq 0.4D$).

As viewed in the direction orthogonal to the third plane S3, the gate rotor center axis 2*a* is inclined against the second plane S2 so that a tooth portion 20 of the gate rotor 2 closer to the screw rotor 1 becomes closer to the screw rotor center axis 1*a* than a tooth portion 20 of the gate rotor 2 farther from the screw rotor 1. An inclination angle α of the gate rotor center axis 2*a* is 5°-30°. In this case, an engagement depth of the tooth portions 20 with the groove portions 10 is 0.2 time as large as an outer diameter D of the gate rotor 2.

As viewed in a direction orthogonal to the first plane S1, a distance L between the gate rotor center axis 2*a* and the screw rotor center axis 1*a* (hereinafter, referred to as axis-to-axis distance L) is 0.7 to 1.2 time as large as the outer diameter D of the gate rotor 2 ($0.7D \leqq L \leqq 1.2D$).

In the gate rotor plane SG, an angle that a center line of the tooth portion 20 engaged with the groove portion 10 forms against a reference line parallel to the axial end face (second plane S2) of the screw rotor 1 is referred to as a gate rotor engagement angle γ, and the angle of the center line (an intermediate line between leading side and unleading side) of the tooth portion 20 is measured from the reference line on a side of engagement starting.

Figure 5:
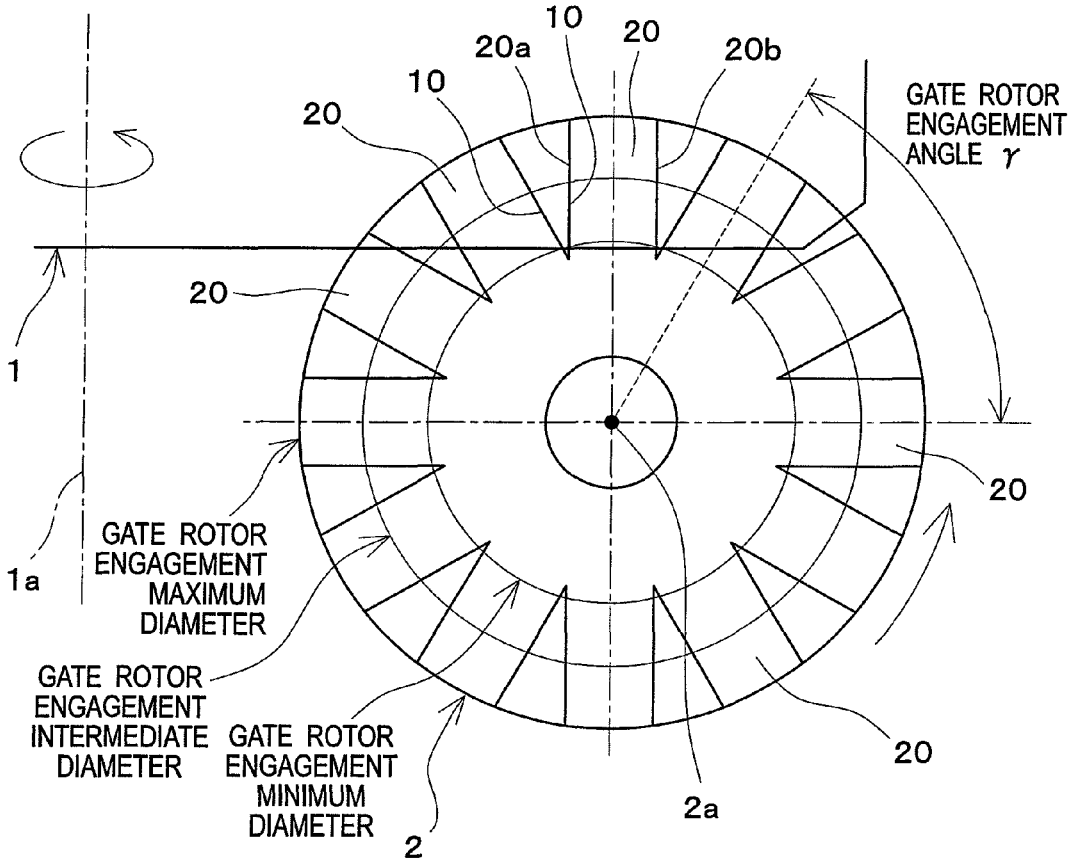
FIG. 5 is a enlarged plan view of the compressor.

The enlarged plan view of FIG. 5 shows, in a tooth portion 20 of the gate rotor 2, a minimum diameter, an intermediate diameter and a maximum diameter of engagement of the gate rotor 2, the engagement being done with the groove portions 10 of the screw rotor 1. Also in the tooth portion 20, a side face on the downstream side of the rotational direction of the gate rotor 2 is assumed as a leading-side side face 20*a* while a side face on the upstream side of the rotational direction of the gate rotor 2 is assumed as an unleading-side side face 20*b*.

Next, FIGS. 6 to 9 show relationships between the gate rotor engagement angle γ (see FIG. 4) and the screw rotor groove inclination angle β when the positional-shift distance d of the gate rotor center axis 2*a* (see FIG. 3) is changed as 0D, 0.1D, 0.2D and 0.3D with the inclination angle α of the gate rotor center axis 2*a* (see FIG. 3) set at 12°. In the figures are plotted engagement maximum diameters and intermediate diameters (see FIG. 5) of the gate rotor 2 with respect to the leading-side side face 20*a* and the unleading-side side face 20*b* (see FIG. 5), respectively. The number of groove portions 10 of the screw rotor 1 is three, and the number of tooth portions 20 of the gate rotor 2 is twelve.

Figure 20:
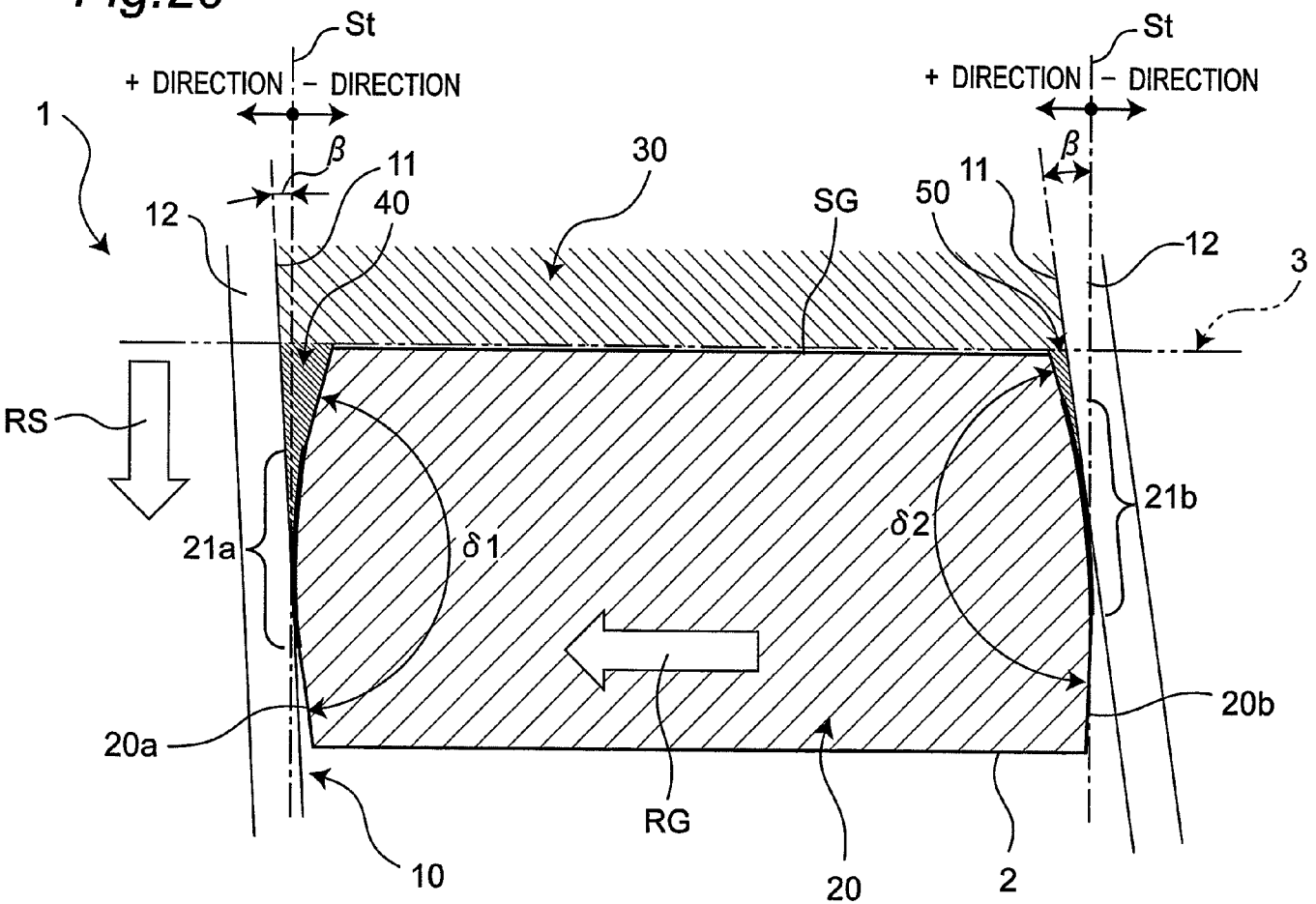
FIG. 20 is an enlarged sectional view of the compressor.

It is to be noted here that the screw rotor groove inclination angle β, as shown in FIG. 20, refers to an angle β formed by the side face 11 of a groove portion 10 of the screw rotor 1 against a plane St which orthogonally intersects with the rotational direction (indicated by an arrow RG) of the gate rotor 2 (i.e. a circumferential direction of the gate rotor 2) at a contact portion of the side face 11 of the groove portion 10 and the tooth portion 20 of the gate rotor 2. In addition, with the plane St taken as a reference, the screw rotor groove inclination angle β is expressed in positive values (+ direction) on the gate rotor rotational direction (arrow RG direction) side, and in negative values (– direction) on the side opposite to the gate rotor rotational direction (arrow RG direction).

Figure 6:
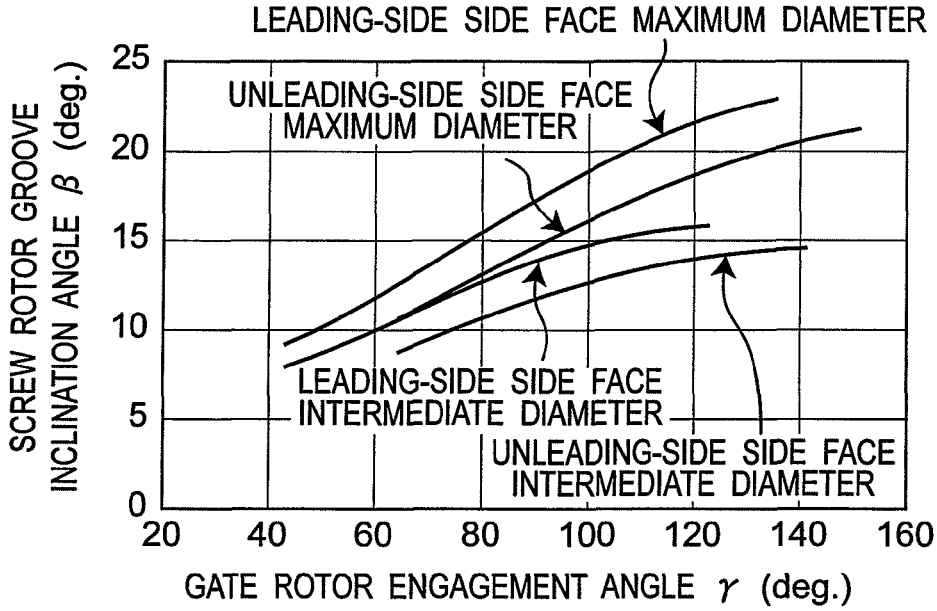
FIG. 6 is a graph showing a relationship between a gate rotor engagement angle γ and a screw rotor groove inclination angle β under the condition that a gate-rotor center axis inclination angle α is 12° and a positional-shift distance d is 0D.

FIG. 6 shows a chart when the positional-shift distance d is 0D, where variation widths of the screw rotor groove inclination angle β become larger with respect to engagement maximum diameters and intermediate diameters of the gate rotor 2 in the leading-side side face 20*a* and the unleading-side side face 20*b*, respectively.

Figure 7:
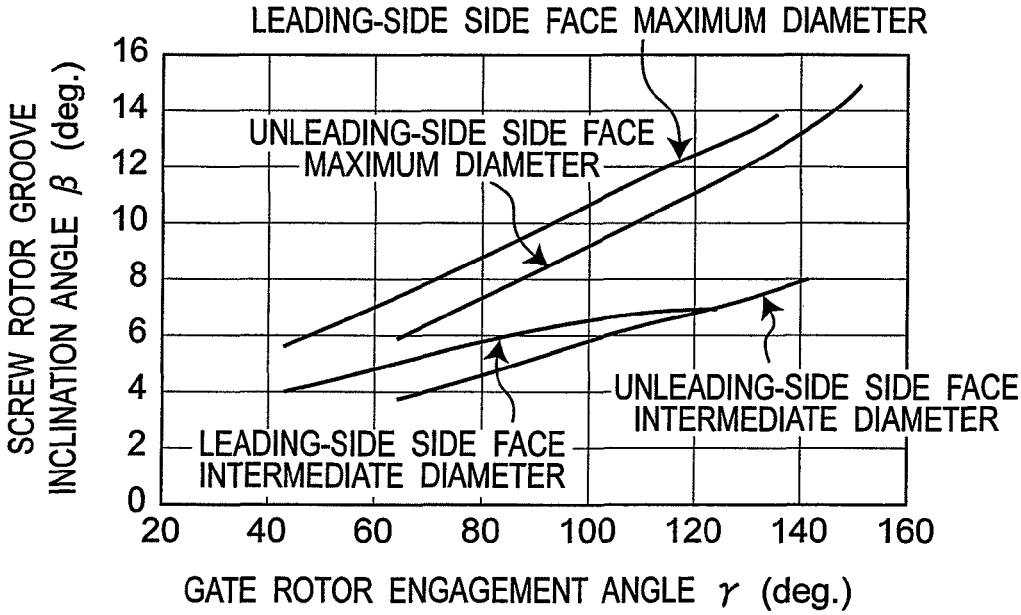
FIG. 7 is a graph showing a relationship between a gate rotor engagement angle γ and a screw rotor groove inclination angle β under the condition that a gate-rotor center axis inclination angle α is 12° and a positional-shift distance d is 0.1D.

FIG. 7 shows a chart when the positional-shift distance d is 0.1D, where variation widths of the screw rotor groove inclination angle β are smaller than those of the screw rotor groove inclination angle β shown in FIG. 6.

Figure 8:
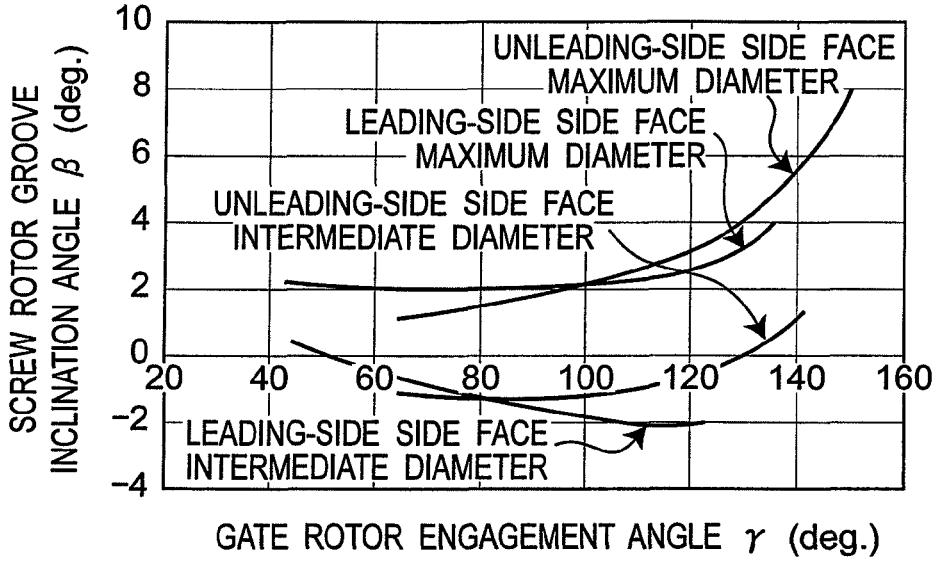
FIG. 8 is a graph showing a relationship between a gate rotor engagement angle γ and a screw rotor groove inclination angle β under the condition that a gate-rotor center axis inclination angle α is 12° and a positional-shift distance d is 0.2D.

FIG. 8 shows a chart when the positional-shift distance d is 0.2D, where variation widths of the screw rotor groove inclination angle β are smaller than those of the screw rotor groove inclination angle β shown in FIG. 7.

Figure 9:
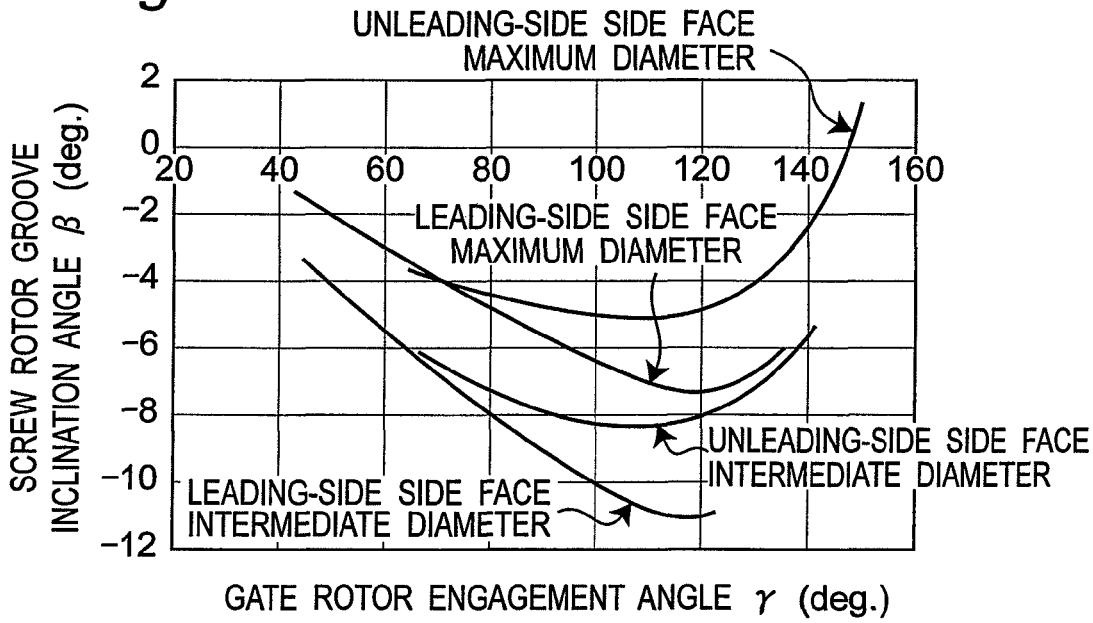
FIG. 9 is a graph showing a relationship between a gate rotor engagement angle γ and a screw rotor groove inclination angle β under the condition that a gate-rotor center axis inclination angle α is 12° and a positional-shift distance d is 0.3D.

FIG. 9 shows a chart when the positional-shift distance d is 0.3D, where variation widths of the screw rotor groove inclination angle β are smaller than those of the screw rotor groove inclination angle β shown in FIG. 6.

Also, FIGS. 10 to 13 show relationships between the gate rotor engagement angle γ and the screw rotor groove inclination angle β when the inclination angle α of the gate rotor center axis 2*a* is changed as 0°, 5°, 12° and 20° with the positional-shift distance d set at 0D. The rest of the conditions are similar to those of FIGS. 6 to 9.

Figure 10:
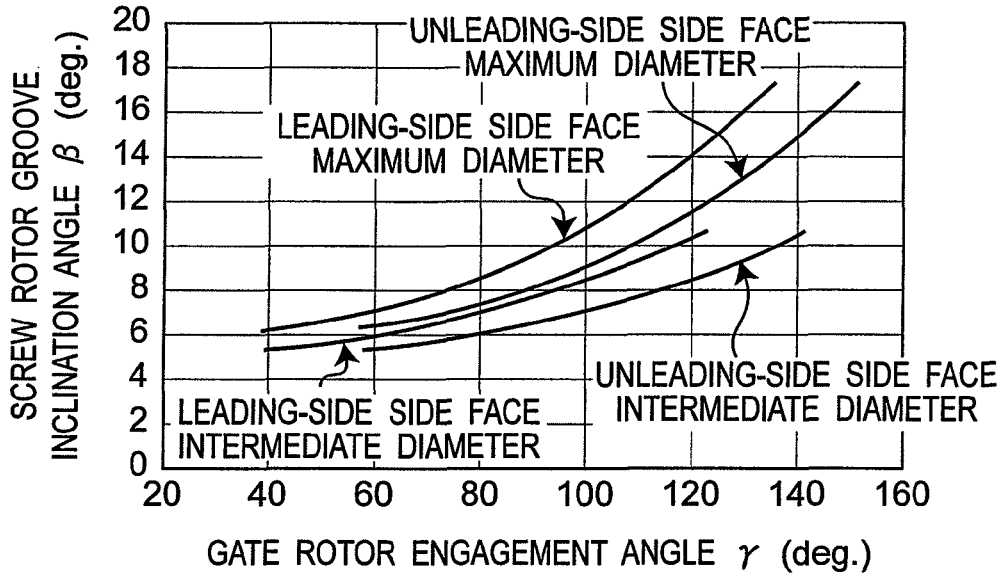
FIG. 10 is a graph showing a relationship between a gate rotor engagement angle γ and a screw rotor groove inclination angle β under the condition that a gate-rotor center axis inclination angle α is 0° and a positional-shift distance d is 0D.
Figure 11:
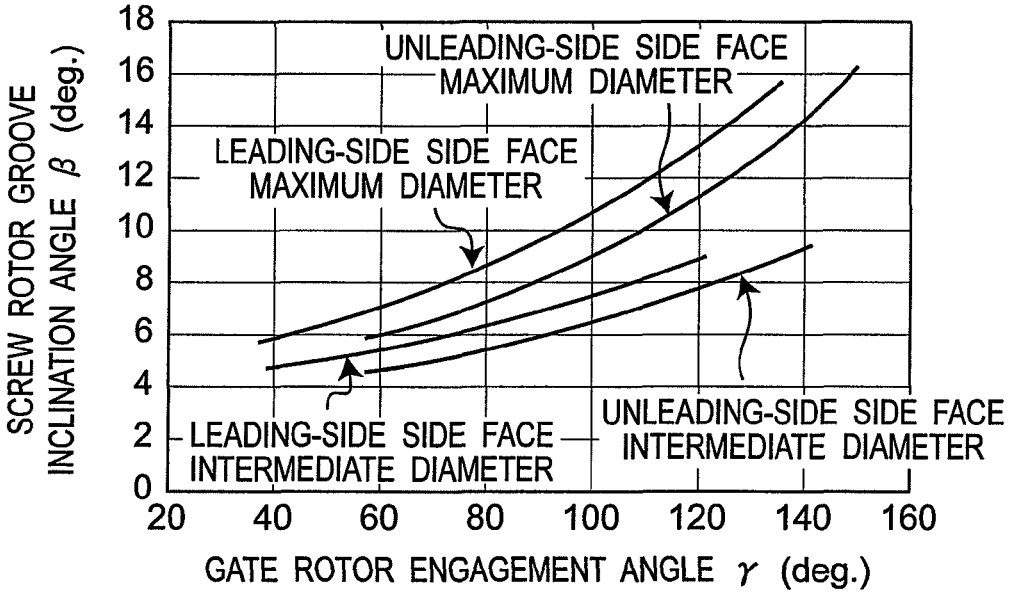
FIG. 11 is a graph showing a relationship between a gate rotor engagement angle γ and a screw rotor groove inclination angle β under the condition that a gate-rotor center axis inclination angle α is 5° and a positional-shift distance d is 0D.
Figure 12:
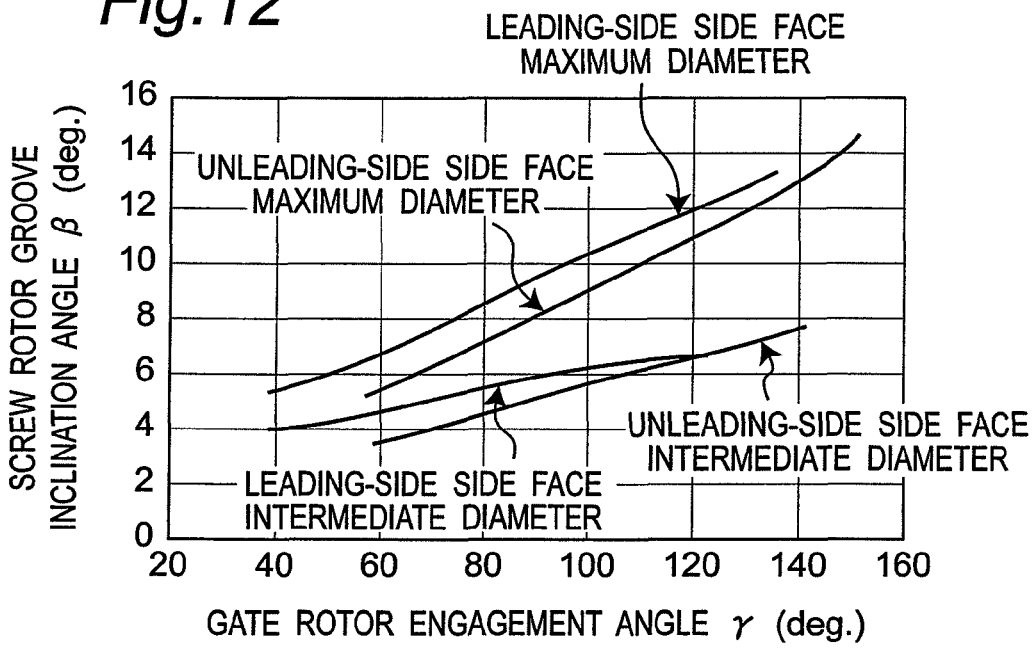
FIG. 12 is a graph showing a relationship between a gate rotor engagement angle γ and a screw rotor groove inclination angle β under the condition that a gate-rotor center axis inclination angle α is 12° and a positional-shift distance d is 0D.
Figure 13:
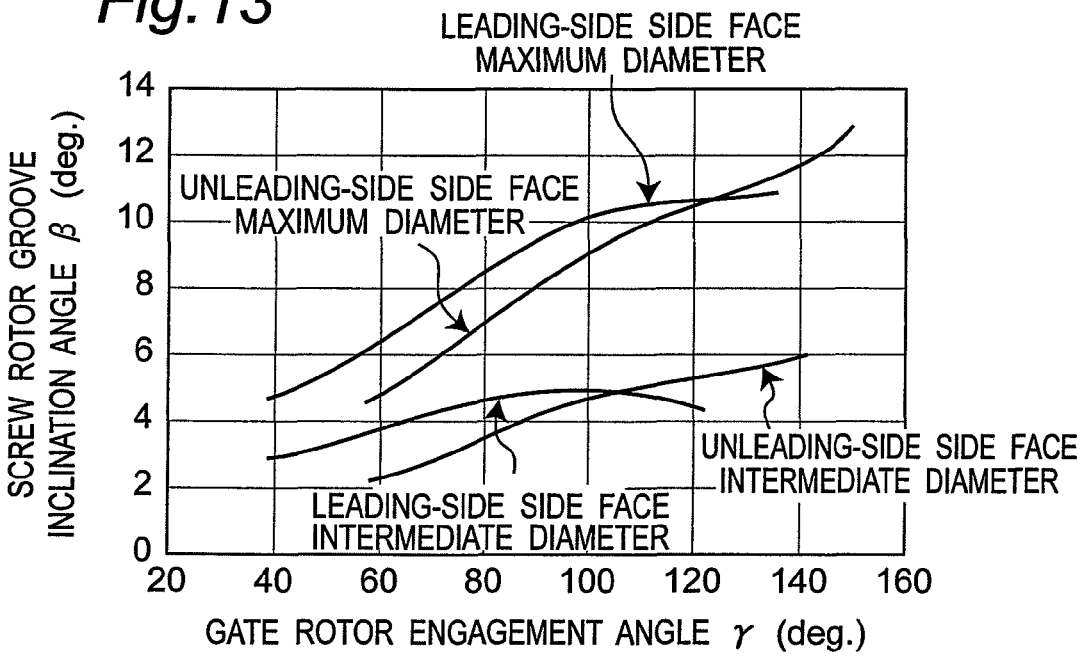
FIG. 13 is a graph showing a relationship between a gate rotor engagement angle γ and a screw rotor groove inclination angle β under the condition that a gate-rotor center axis inclination angle α is 20° and a positional-shift distance d is 0D.

FIG. 10 shows a chart when the inclination angle α of the gate rotor center axis 2*a* is 0°, FIG. 11 shows a chart when the inclination angle α of the gate rotor center axis 2*a* is 5°, FIG. 12 shows a chart when the inclination angle α of the gate rotor center axis 2*a* is 12°, and FIG. 13 shows a chart when the inclination angle α of the gate rotor center axis 2*a* is 20°, where the variation width of the screw rotor groove inclination angle β becomes smaller as the inclination angle α of the gate rotor center axis 2*a* becomes larger.

That is, in FIGS. 11 to 13, since at least one of all the tooth portions 20 of the gate rotor 2 does not overlap with the first plane S1, the variation width of the screw rotor groove inclination angle β can be made smaller as compared with the case where all the tooth portions 20 of the gate rotor 2 shown in FIG. 10 overlap with the first plane S1.

Also, FIGS. 14 to 19 show relationships between the gate rotor engagement angle γ and the screw rotor groove inclination angle β when the positional-shift distance d is changed as 0D, 0.05D, 0.1D, 0.15D, 0.2D and 0.3D with the inclination angle α of the gate rotor center axis 2*a* set at 0°. The rest of the conditions are similar to those of FIGS. 6 to 9.

Figure 14:
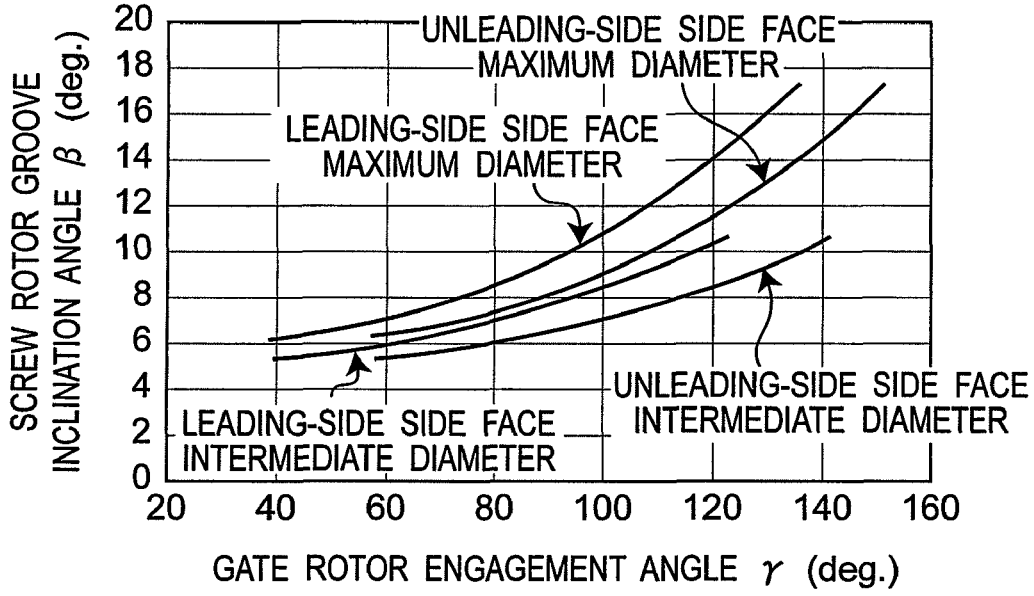
FIG. 14 is a graph showing a relationship between a gate rotor engagement angle γ and a screw rotor groove inclination angle β under the condition that a gate-rotor center axis inclination angle α is 0° and a positional-shift distance d is 0D.
Figure 15:
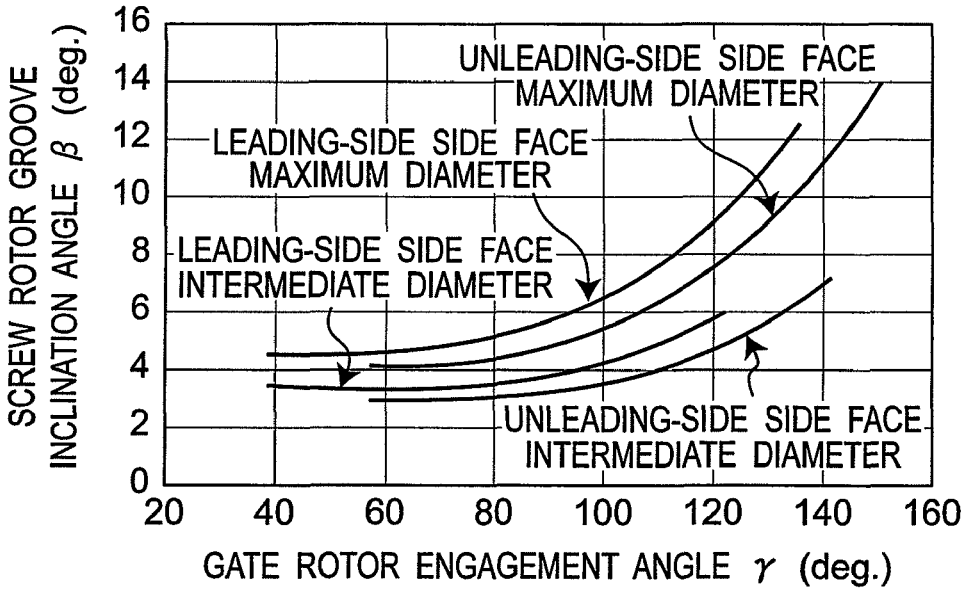
FIG. 15 is a graph showing a relationship between a gate rotor engagement angle γ and a screw rotor groove inclination angle β under the condition that a gate-rotor center axis inclination angle α is 0° and a positional-shift distance d is 0.05D.
Figure 16:
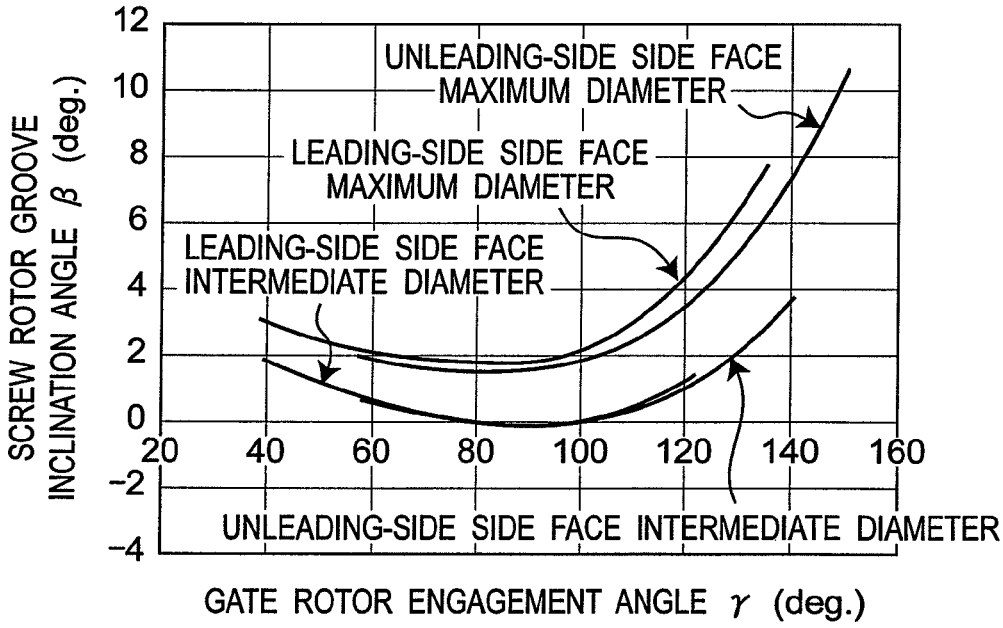
FIG. 16 is a graph showing a relationship between a gate rotor engagement angle γ and a screw rotor groove inclination angle β under the condition that a gate-rotor center axis inclination angle α is 0° and a positional-shift distance d is 0.1D.
Figure 17:
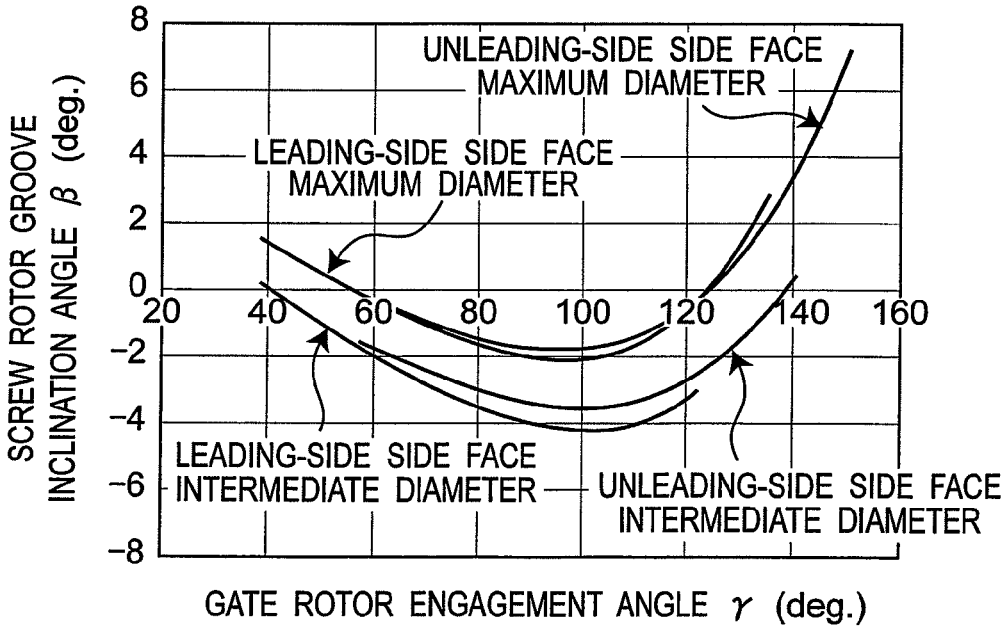
FIG. 17 is a graph showing a relationship between a gate rotor engagement angle γ and a screw rotor groove inclination angle β under the condition that a gate-rotor center axis inclination angle α is 0° and a positional-shift distance d is 0.15D.
Figure 18:
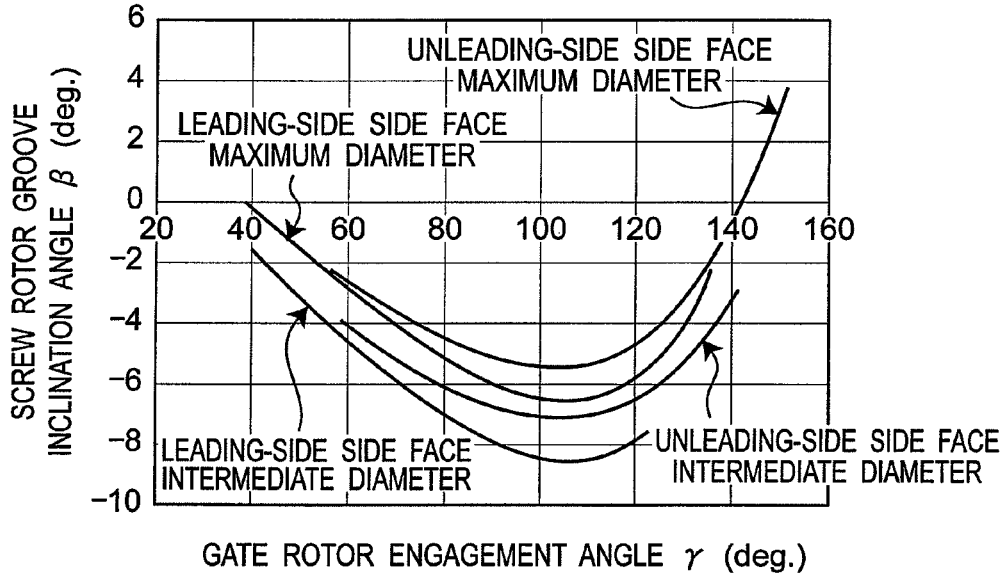
FIG. 18 is a graph showing a relationship between a gate rotor engagement angle γ and a screw rotor groove inclination angle β under the condition that a gate-rotor center axis inclination angle α is 0° and a positional-shift distance d is 0.2D.
Figure 19:
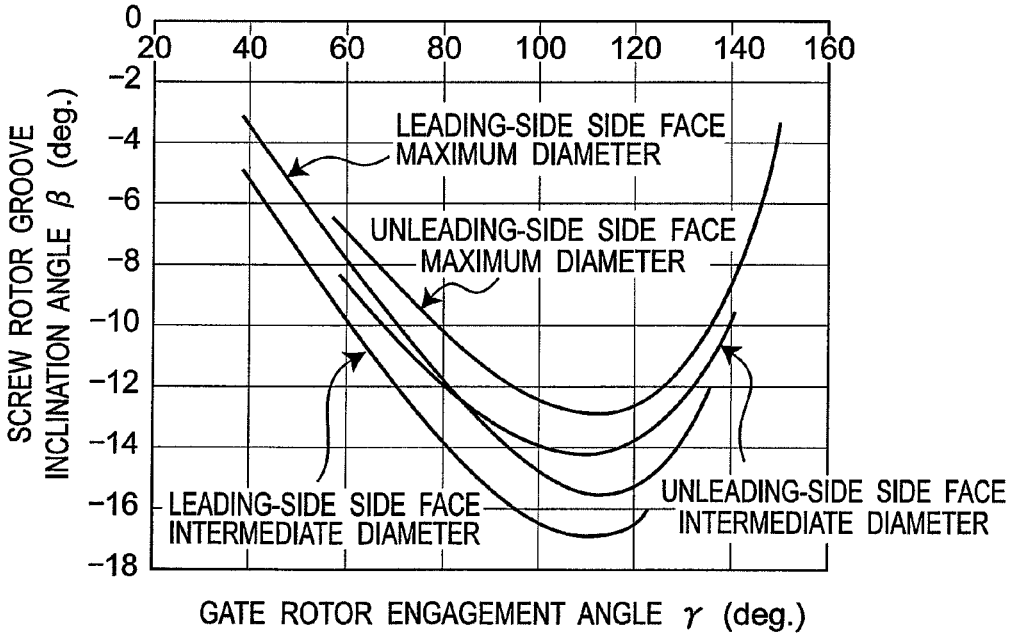
FIG. 19 is a graph showing a relationship between a gate rotor engagement angle γ and a screw rotor groove inclination angle β under the condition that a gate-rotor center axis inclination angle α is 0° and a positional-shift distance d is 0.3D.

FIG. 14 shows a chart when the positional-shift distance d is 0D, FIG. 15 shows a chart when the positional-shift distance d is 0.05D, FIG. 16 shows a chart when the positional-shift distance d is 0.1D, FIG. 17 shows a chart when the positional-shift distance d is 0.15D, FIG. 18 shows a chart when the positional-shift distance d is 0.2D, and FIG. 19 shows a chart when the positional-shift distance d is 0.3D, where the variation width of the screw rotor groove inclination angle β is smaller when the positional-shift distance d is larger than 0D.

That is, in FIGS. 15 to 19, since none of the tooth portions 20 of the gate rotor 2 overlaps with the first plane S1, the variation width of the screw rotor groove inclination angle β can be made smaller as compared with the case where all the tooth portions 20 of the gate rotor 2 shown in FIG. 14 overlap with the first plane S1.

As shown in the enlarged sectional view of FIG. 20, seal portions 21*a*, 21*b* of the tooth portions 20 of the gate rotor 2 to be in contact with the groove portions 10 of the screw rotor 1 are formed into a curved-surface shape.

That is, a leading-side seal portion 21*a* is formed at the leading-side side face 20*a* of the tooth portion 20, while an unleading-side seal portion 21*b* is formed at the unleading-side side face 20*b* of the tooth portion 20.

The screw rotor 1 moves along a downward-pointed arrow RS direction, while the gate rotor 2 moves along a leftward-pointed arrow RG direction.

At engagement portions between the groove portion 10 of the screw rotor 1 and the tooth portion 20 of the gate rotor 2, blow holes (leak clearances) 40, 50 shown by hatching are present.

More specifically, a leading-side blow hole 40 (shown by hatching) is present on an upstream side (compression chamber 30 side shown by hatching) of the leading-side seal portion 21*a* in the moving direction of the screw rotor 1, while an unleading-side blow hole 50 (shown by hatching) is present on an upstream side (the compression chamber 30 side) of the unleading-side seal portion 21*b* in the moving direction of the screw rotor 1.

The fluid compressed in the compression chamber 30 passes through the blow holes 40, 50 to leak outside the casing 3 (shown by imaginary line).

Figure 21:
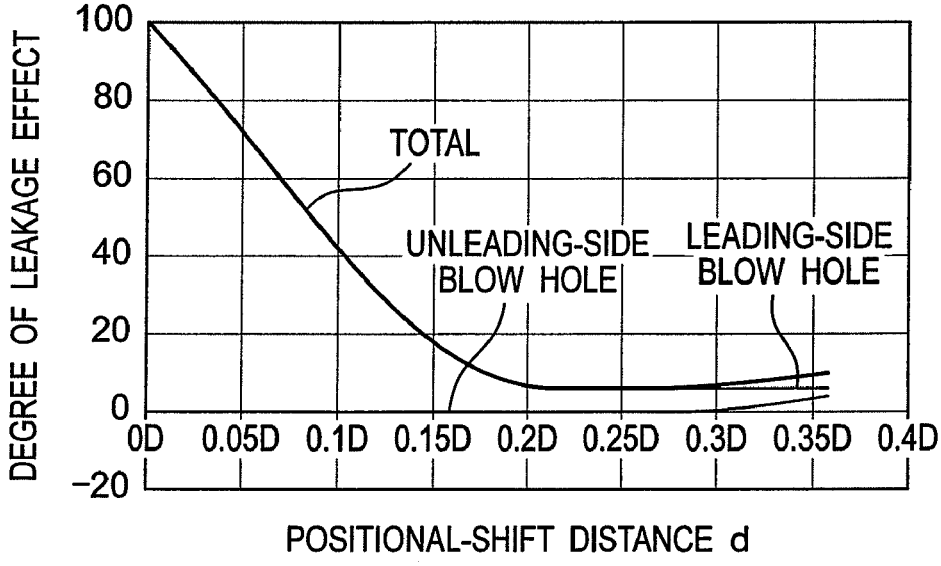
FIG. 21 is a graph showing a relationship between the positional-shift distance d and the degree of leakage effect with three screw rotor groove portions and twelve gate rotor tooth portions provided.
Figure 22:
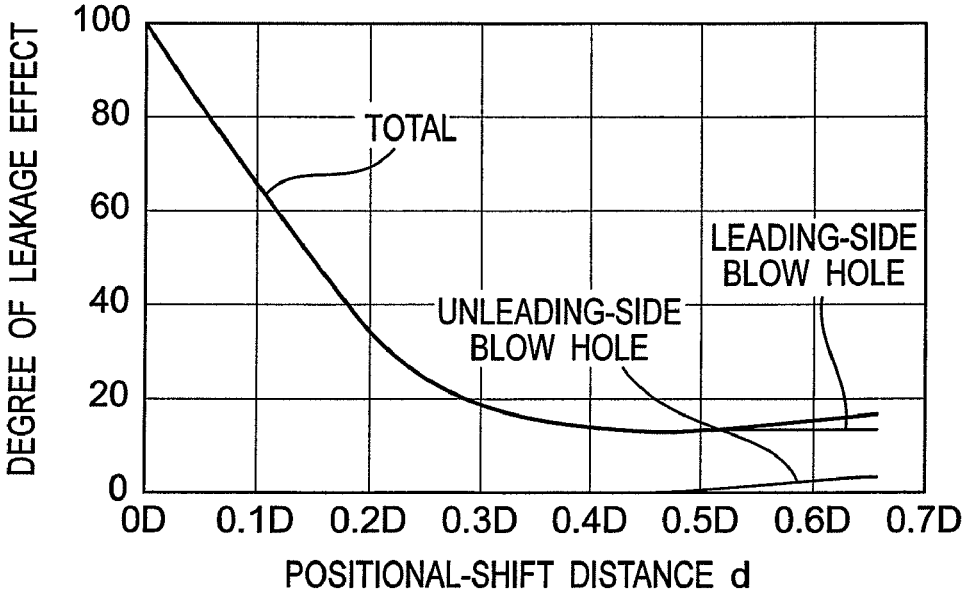
FIG. 22 is a graph showing a relationship between the positional-shift distance d and the degree of leakage effect with six screw rotor groove portions and twelve gate rotor tooth portions provided.

FIGS. 21 and 22 show a relationship between the positional-shift distance d (see FIG. 3) and the degree of leakage effect. In this case, only the positional-shift distance d is changed within a range of 0D to 0.4D without any inclination of the gate rotor center axis 2*a* (α=0°). A degree of leakage effect of the leading-side blow hole 40 (see FIG. 20), a degree of leakage effect of the unleading-side blow hole 50 (see FIG. 20), and a total degree of leakage effect of the leading-side blow hole 40 and the unleading-side blow hole 50 are shown.

It is noted here that the term, "degree of leakage effect," refers to a degree obtained by converting areas of the leading-side blow hole 40 and the unleading-side blow hole 50 into corresponding leak amounts, respectively, wherein a degree of 100 corresponds to a leak amounts when the positional-shift distance d is 0D (as in the conventional case).

FIG. 21 shows degrees of leakage effect when the number of groove portions 10 of the screw rotor 1 is three and the number of tooth portions 20 of the gate rotor 2 is twelve. As the positional-shift distance d becomes larger, the degree of leakage effect becomes smaller, so that the compression efficiency is improved.

FIG. 22 shows degrees of leakage effect when the number of groove portions 10 of the screw rotor 1 is six and the number of tooth portions 20 of the gate rotor 2 is twelve. As the positional-shift distance d becomes larger, the degree of leakage effect becomes smaller, so that the compression efficiency is improved.

According to the compressor of the above-described constitution, since the gate rotor center axis 2*a* is present on the third plane S3 and since at least one of all the tooth portions 20 of the gate rotor 2 does not overlap with the first plane S1 as viewed in a direction orthogonal to the third plane S3, side faces 11 of a groove portion 10 of the screw rotor 1 to be in contact with the tooth portion 20 of the gate rotor 2 can be set at approximately 90° against the rotational direction (indicated by arrow RG) of the tooth portion 20 of the gate rotor 2 to be in contact with the side faces 11 of the groove portion 10 of the screw rotor 1 (i.e. against the circumferential direction of the gate rotor 2) as shown in FIG. 20. Thus, the variation width of the screw rotor groove inclination angle β can be reduced.

More specifically, in cases where the positional shift or inclination of the gate rotor 2 as in the present invention is not used (prior art), the changing width of the screw rotor groove inclination angle β during the course from suction to discharge becomes 16.0° at the leading-side side face 20*a* and 15.6° at the unleading-side side face 20*b*. In contrast to this, in a case where the positional shift or inclination of the gate rotor 2 of the invention is applied to a compressor whose configuration (gate rotor tooth number, screw rotor groove number, gate rotor diameter, axis-to-axis distance, gate rotor tooth width, and suction cut angle) is similar to that of the prior art, the results are 6.5° at that the leading-side side face 20*a* and 13.8° at the unleading-side side face 20*b*.

In other words, the variation width of the inclination angle of the side faces 11 of the groove portion 10 of the screw rotor 1 to be in contact with the tooth portion 20 of the gate rotor 2, the inclination being against the circumferential direction of the gate rotor 2 and the variation width measuring from a radially outer side of the screw rotor 1 to its inner side, is made smaller, as compared with the variation width resulting when all the tooth portions of the gate rotor 2 overlap with the first plane S1 containing the screw rotor center axis 1*a*. In addition, the term, "circumferential direction of the gate rotor 2," can be reworded as the rotational direction of the tooth portion 20 of the gate rotor 2 to be in contact with the side faces 11 of the groove portion 10 of the screw rotor 1. Also, the term, "variation width of the screw rotor 1 from a radially outer side of the screw rotor 1 to its inner side," refers to a variation width of the inclination angles of all the groove portions 10 from radially outer side to inner side of the screw rotor 1 to be concurrently in contact with the tooth portions 20 of the gate rotor 2.

Therefore, edge angles δ1, δ2 (see FIG. 20) of the seal portions of the gate rotor 2 to be engaged with the side faces of the groove portions 10 of the screw rotor 1 can be made obtuse, so that the blow holes (leak clearances) present at engagement portions between the groove portions 10 of the screw rotor 1 and the tooth portions 20 of the gate rotor 2 can be made smaller. Thus, the compression efficiency can be improved. Besides, wear of the seal portions of the gate rotor 2 can be reduced, allowing an improvement in durability to be achieved.

In consequence, in the present invention, it has been found that in the PP-type single screw compressor, the angle of side faces of the groove portions 10 of the screw rotor 1 to be in contact with the tooth portions 20 of the gate rotor 2 is varied by shifting the position of the gate rotor 2 relative to the screw rotor 1.

Also, since the positional-shift distance d is 0.05 to 0.4 time as large as the outer diameter D of the tooth portion 20 of the gate rotor as viewed in the direction orthogonal to the third plane S3, the variation width of the screw rotor groove inclination angle β can be made even smaller.

Also, as viewed in the direction orthogonal to the third plane S3, the gate rotor center axis 2*a* is inclined by 5° to 30° against the second plane S2 so that a tooth portion 20 of the gate rotor 2 closer to the screw rotor 1 becomes closer to the screw rotor center axis la than a tooth portion 20 of the gate rotor 2 farther from the screw rotor 1. Therefore, the variation width of the screw rotor groove inclination angle β can be made even smaller.

That is, in the PP-type single screw compressor, the velocity of the screw rotor 1 engaged with the gate rotor 2 has large differences between outer peripheral portions and central portion. In particular, at the central portion of the screw rotor 1, the rotational speed of the gate rotor 2 becomes larger relative to the rotational speed of the screw rotor 1, so that the screw rotor groove inclination angle β is varied to a large extent.

As a solution to this, it can be conceived to increase the axis-to-axis distance L between the screw rotor 1 and the gate rotor 2 so that velocity changes of the screw rotor 1 between outer peripheral portions and central portion of the screw rotor 1 becomes small. However, this incurs a problem that the outer diameter of the screw rotor 1 is increased, leading to an increased maximum diameter of the compressor.

Accordingly, by making the gate rotor center axis 2*a* inclined by 5° to 30° against a plane orthogonal to the screw rotor center axis 1*a*, the variation width of the screw rotor groove inclination angle β can be made smaller without increasing the outer diameter of the screw rotor 1.

Also, as viewed in the direction orthogonal to the first plane S1, the distance L between the gate rotor center axis 2*a* and the screw rotor center axis 1*a* is 0.7 to 1.2 times as large as the outer diameter D of the gate rotor 2. Therefore, the distance L can be made smaller, allowing a downsizing to be achieved.

In other words, since the changing width of the screw rotor groove inclination angle β can be made small, the variation width of the contact angle between the gate rotor 2 and the screw rotor 1 can be suppressed even if the distance L is reduced. Thus, the downsizing can be achieved while the compression efficiency is maintained.

Also, since the seal portions 21*a*, 21*b* of the tooth portions 20 of the gate rotor 2 to be in contact with the groove portions 10 of the screw rotor 1 are formed into a curved-surface shape, leaks of the compressed fluid from engagement portions between the tooth portions 20 of the gate rotor 2 and the groove portions 10 of the screw rotor 1 can be reduced, so that the compression efficiency can be improved.

In other words, since the variation width of the screw rotor groove inclination angle β can be made small, the seal portions 21*a*, 21*b* of the gate rotor 2 can be formed into a curved-surface shape. More specifically, without increasing the thickness of the gate rotor 2, maximum and minimum values of the inclination angle of the seal portions 21*a*, 21*b* can be fulfilled by machining the groove portions 10 of the screw rotor 1 with an end mill and by forming the seal portions 21*a*, 21*b* of the tooth portions 20 of the gate rotor 2 into a curved-surface shape with an end mill.

The present invention is not limited to the above-described embodiment. For example, the groove portion 10 may be provided only in one of the end faces of the screw rotor 1. Also, the number of the gate rotors 2 may be freely increased or decreased. Further, the seal portions 21*a*, 21*b* of the tooth portions 20 of the gate rotor 2 to be in contact with the groove portions 10 of the screw rotor 1 may also be formed into an acute-angle shape. Besides, the screw rotor 1 and the gate rotor 2 may be rotated in opposite directions.

What is claimed is:

1. A compressor comprising:

a disc-shaped screw rotor arranged to rotate about a center axis, the screw rotor having a plurality of spirally extending groove portions disposed radially outwardly from the center axis of the screw rotor, with the groove portions being formed in at least one end face of the screw rotor facing a direction parallel to the center axis of the screw rotor; and a gate rotor arranged to rotate about a center axis and which has a plurality of tooth portions circumferentially arranged on an outer circumference of the gate rotor, with the groove portions of the screw rotor and the tooth portions of the gate rotor being engaged with each other to form a compression chamber, the screw rotor and the gate rotor being configured and arranged such that a first plane contains the screw rotor center axis, a second plane orthogonally intersects the screw rotor center axis, and a third plane orthogonally intersects the first plane and the second plane, the gate rotor center axis is on the third plane, at least one of the tooth portions of the gate rotor does not overlap with the first plane as viewed in a direction orthogonal to the third plane, and the gate rotor center axis is inclined relative to the second plane so that the tooth portions of the gate rotor closer to the screw rotor than other tooth portions are closer to the screw rotor center axis than the other tooth portions of the gate rotor farther from the screw rotor as viewed in the direction orthogonal to the third plane.

2. The compressor as claimed in claim 1, wherein a distance between the gate rotor center axis and the screw rotor center axis is 0.7 to 1.2 times as large as an outer diameter of the gate rotor as viewed in a direction orthogonal to the first plane.

3. The compressor as claimed in claim 1, wherein the tooth portions of the gate rotor include seal portions configured to be in contact with the groove portions of the screw rotor, and the seal portions are formed into a curved-surface shape.

4. A compressor comprising:

a disc-shaped screw rotor arranged to rotate about a center axis, the screw rotor having a plurality of spirally extending groove portions disposed radially outwardly from the center axis of the screw rotor, with the groove portions being formed in at least one end face of the screw rotor facing a direction parallel to the center axis of the screw rotor; and a gate rotor arranged to rotate about a center axis and which has a plurality of tooth portions circumferentially arranged on an outer circumference of the gate rotor, with the groove portions of the screw rotor and the tooth portions of the gate rotor being engaged with each other to form a compression chamber, the screw rotor and the gate rotor being configured and arranged such that a first plane contains the screw rotor center axis, a second plane orthogonally intersects the screw rotor center axis, and a third plane orthogonally intersects the first plane and the second plane, the gate rotor center axis is on the third plane, at least one of the tooth portions of the gate rotor does not overlap with the first plane as viewed in a direction orthogonal to the third plane, and a distance from an intersection point between a gate rotor plane and the gate rotor center axis to the first plane is 0.05 to 0.4 times as large as an outer diameter of the tooth portions of the gate rotor as viewed in the direction orthogonal to the third plane, the gate rotor plane being formed on a first plane side end face of the tooth portions of the gate rotor.

5. A compressor comprising:

a disc-shaped screw rotor arranged to rotate about a center axis, the screw rotor having a plurality of spirally extending groove portions disposed radially outwardly from the center axis of the screw rotor, with the groove portions being formed in at least one end face of the screw rotor facing a direction parallel to the center axis of the screw rotor; and a gate rotor arranged to rotate about a center axis and which has a plurality of tooth portions circumferentially arranged on an outer circumference of the gate rotor, with the groove portions of the screw rotor and the tooth portions of the gate rotor being engaged with each other to form a compression chamber, the screw rotor and the gate rotor being configured and arranged such that a first plane contains the screw rotor center axis, a second plane orthogonally intersects the screw rotor center axis, and a third plane orthogonally intersects the first plane and the second plane, the gate rotor center axis is on the third plane, at least one of the tooth portions of the gate rotor does not overlap with the first plane as viewed in a direction orthogonal to the third plane, and the gate rotor center axis is inclined 5° to 30° relative to the second plane so that the tooth portions of the gate rotor closer to the screw rotor than other tooth portions are closer to the screw rotor center axis than the other tooth portions of the gate rotor farther from the screw rotor as viewed in the direction orthogonal to the third plane.

* * * * *